US011638480B2

(12) United States Patent
Felsenthal et al.

(10) Patent No.: US 11,638,480 B2
(45) Date of Patent: May 2, 2023

(54) LUGGAGE RACK WITH SHELVES

(71) Applicant: Whitmor, Inc., Southaven, MS (US)

(72) Inventors: Sandy A. Felsenthal, Memphis, MS (US); Gil Gaska, Germantown, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 17/094,763

(22) Filed: Nov. 10, 2020

(65) Prior Publication Data

US 2022/0142358 A1 May 12, 2022

(51) Int. Cl.

| | |
|---|---|
| ***A47B 43/00*** | (2006.01) |
| ***A47B 43/04*** | (2006.01) |
| ***A47B 61/06*** | (2006.01) |

(52) U.S. Cl.

CPC ..... *A47B 43/003* (2013.01); *A47B 43/04* (2013.01); *A47B 61/06* (2013.01)

(58) Field of Classification Search

CPC ..... A47B 43/003; A47B 43/04; A47B 61/06; A47C 4/52

USPC ..... 211/202

See application file for complete search history.

(56) References Cited

U.S. PATENT DOCUMENTS 526,249 A * 9/1894 Meeker ..... B65D 37/00 220/9.3
1,274,306 A * 7/1918 Moisson ..... D06F 57/10 211/202
1,685,925 A * 10/1928 Linck ..... A47B 61/003 211/200
2,375,819 A * 5/1945 Reid ..... A47C 9/10 108/115
2,558,995 A * 7/1951 Tullis ..... A47C 4/283 190/8
2,574,563 A * 11/1951 Hieb ..... D06F 95/004 220/9.3
2,638,399 A * 5/1953 Seymour ..... D06F 95/004 312/297
2,727,564 A * 12/1955 Gruber ..... A47C 5/04 108/91
2,843,185 A * 7/1958 Clem ..... A45F 4/02 248/164
3,000,416 A * 9/1961 Lindegren ..... D06F 95/004 220/9.3
3,033,379 A * 5/1962 Clark ..... D06F 57/08 211/200

(Continued)

FOREIGN PATENT DOCUMENTS

FR 1165671 A * 10/1958 ..... A47C 4/52
FR 1491264 A * 8/1967 ..... A47B 67/00

(Continued)

*Primary Examiner* — Stanton L Krycinski

(74) *Attorney, Agent, or Firm* — Stites & Harbison PLLC; Richard S. Myers, Jr.

(57) ABSTRACT

A luggage rack that includes a frame and a storage compartment, with the frame comprising two legs that have a first end, an upper portion, and a second end; said legs being joint at a first and second pivot point, the pivot point being between the ends and the upper portion; at least one support band attached to the upper portions of both legs; the storage compartment comprising a top, bottom, and two outer walls; and at least one support strap releasably attached to the upper portion of the first leg and the upper portion of the second leg.

12 Claims, 5 Drawing Sheets

(56) References Cited

U.S. PATENT DOCUMENTS 3,839,754 A * 10/1974 Hooper ..... A47D 7/002 5/98.2
4,003,455 A * 1/1977 Cortese ..... A47C 4/52 190/8
4,029,278 A * 6/1977 Napoleon ..... A47C 7/008 248/188.2
4,588,154 A * 5/1986 Basore ..... B65B 67/1244 211/206
4,646,802 A * 3/1987 Basore ..... B65B 67/1244 220/495.11
4,979,705 A * 12/1990 Bovitz ..... B65B 67/1238 209/937
5,146,635 A * 9/1992 Gastie ..... A61D 3/00 108/118
5,190,254 A * 3/1993 Maguire ..... F16M 11/245 248/164
D341,687 S * 11/1993 Park ..... D34/5
5,263,602 A * 11/1993 Lathouris ..... B65F 1/1463 206/430
5,507,577 A * 4/1996 Fowler ..... B65B 67/12 220/9.4
5,667,066 A * 9/1997 Simpson ..... B65B 67/1244 206/278
5,722,717 A * 3/1998 Rettenberger ..... A47C 7/628 297/188.1
D404,861 S * 1/1999 Balensiefer, II ..... D32/37
6,000,752 A * 12/1999 Shyr ..... A47C 4/38 297/188.08
6,048,023 A * 4/2000 Lampton ..... A45C 15/00 297/129
6,296,133 B1 * 10/2001 Cobane ..... B65D 7/26 206/321
6,318,822 B1 * 11/2001 Wang ..... A47B 43/003 108/149
6,375,258 B1 * 4/2002 Fang ..... A47C 9/10 224/155
6,390,573 B1 * 5/2002 Wang ..... A47B 61/00 108/149
6,443,321 B1 * 9/2002 Felsenthal ..... A47B 43/00 211/195
6,719,157 B2 * 4/2004 Stoddart ..... A47B 43/00 211/118
6,814,333 B1 * 11/2004 Freiburger ..... F16M 11/38 248/150
7,063,397 B2 * 6/2006 Sabounjian ..... A47B 43/003 206/287.1
7,080,653 B2 * 7/2006 Zheng ..... B60J 1/2091 135/126
7,114,773 B2 * 10/2006 Ho ..... A47C 4/24 297/188.08
7,168,666 B2 * 1/2007 Tucker ..... B25H 1/04 182/181.1
7,258,232 B2 * 8/2007 Bradford ..... B65D 19/18 206/386
7,681,728 B2 * 3/2010 Sabounjian ..... A47B 43/003 206/278.1
8,033,405 B2 * 10/2011 Wang ..... A47B 43/02 211/118
8,459,473 B2 * 6/2013 Wang ..... A47B 43/003 211/118
8,540,089 B2 * 9/2013 Wang ..... A47B 43/003 211/118
8,998,011 B2 * 4/2015 Zhu ..... A47B 87/0292 211/201
9,211,002 B2 * 12/2015 Lo ..... A47B 47/06
D762,336 S * 7/2016 Chang ..... D32/37
9,409,679 B2 * 8/2016 Rumbough ..... A45C 3/04
D768,348 S * 10/2016 Kellogg ..... D32/36
D787,767 S * 5/2017 Wall ..... D32/37
D855,916 S * 8/2019 Li ..... D32/37
D856,617 S * 8/2019 Li ..... D32/37
D862,019 S * 10/2019 Liu ..... D32/37
D900,706 S * 11/2020 Wang ..... D12/317
2004/0251795 A1 * 12/2004 Wang ..... A47B 67/00 312/6
2005/0140253 A1 * 6/2005 Fu ..... A47B 96/024 312/6
2007/0200469 A1 * 8/2007 Wang ..... A47B 43/003 312/3
2007/0200470 A1 * 8/2007 Wang ..... A47B 43/003 312/6
2009/0184117 A1 * 7/2009 Wang ..... D06F 95/004 220/9.2
2011/0278249 A1 * 11/2011 Wang ..... A47B 43/003 211/118
2012/0217248 A1 * 8/2012 Ma ..... B32B 37/0084 220/500
2012/0299454 A1 * 11/2012 Sabounjian ..... A47B 43/04 312/258
2017/0119151 A1 * 5/2017 Barber ..... A47B 61/003

FOREIGN PATENT DOCUMENTS

FR 2833145 A1 * 6/2003 ..... A47B 3/083
GB 614688 A * 12/1948 ..... A47C 9/10
GB 1561977 A * 3/1980 ..... A47C 4/283

* cited by examiner

LUGGAGE RACK WITH SHELVES

FIELD OF THE INVENTION

The present invention relates to collapsible racks and more particularly to a foldable luggage rack that incorporates storage shelves or boxes. The additional storage boxes may attach to and hang from the top of the luggage rack.

BACKGROUND OF THE INVENTION

Luggage racks, and folding luggage racks are known in the art. They are typically collapsible so that they use little room when not in use. The luggage racks are especially well known for their convenience in hotel rooms, bedrooms in private homes, dormitories, for example. Although they may be used in closet space, these luggage racks allow for storage and accessibility of luggage in an open space of a room.

They allow for easy storage of suitcases and other luggage articles, and typically allow access to such articles when resting on the luggage racks.

Typically, these luggage racks are lightweight, foldable or collapsible, and provide a seat for a piece of luggage. The height of the luggage rack allows for the suitcase or other piece of luggage to be stored off the floor and at a height that allows for easy accessibility.

Despite the advantages of the common luggage rack, the present inventors realize that a long-felt need exists to make these devises even more useful and convenient for the user. The present invention meets this need.

SUMMARY OF THE INVENTION

One object of the present invention is to provide a luggage rack that includes a seat portion, upon which a piece of luggage, such a suitcase can sit, that includes storage shelves or boxes suspended therefrom.

In other embodiments, the storage shelves or boxes are detachable from the rack.

Another object is a luggage rack that includes a frame and a storage compartment, with the frame comprising two legs that have a first end, an upper portion, and a second end. Typically, the ends of the legs rest on a floor. The legs being joint at a first and second pivot point, the pivot point being between the ends and the upper portion; and at least one support band attached to the upper portions of both legs. The storage compartment comprises a top, bottom, and two outer walls; and at least one support strap releasably attached to the upper portion of the first leg and the upper portion of the second leg.

In another embodiment, the storage compartment hangs from the upper portions by the support straps.

In another embodiment, at least two support bands join the upper portions of the legs.

In another embodiment, the storage compartment has four support straps for attaching to the upper portions of the legs.

In another embodiment, the storage compartment further includes an inner wall that joins the top and bottom of the storage compartment.

In another embodiment, the storage compartment is fabric. In other aspects of this embodiment, the storage compartment outer walls and inner wall are at least partially a mesh fabric.

In another embodiment, the frame has four supports bands connecting the tops of the legs, and the storage compartment has six support straps for attaching to the legs.

In another embodiment, the bottom of the storage compartment has a border that has increased stiffness when compared to the remainder of the bottom. In one aspect of this embodiment, the border includes a wire support.

In another embodiment, the storage compartment support straps releasably attach to the legs with a hook and loop connection.

In another embodiment, the pivot points allow the upper portions of the legs to be folded from an open position to a folded position; wherein the storage compartment collapses into a folded position when the legs are pivoted into the folded position and expands into an open position when the legs are pivoted into the open position.

These and other objects of the present invention will become readily apparent while reviewing the preferred embodiments and examples of the present invention disclosed herein in the description of the invention below and the accompanying drawings.

BRIEF DESCRIPTION OF THE FIGURES

In the accompanying drawings, which form a part of the specification and is to be read in conjunction therewith in which like reference numerals are used to indicate like or similar parts in the various views.

DESCRIPTION OF THE INVENTION

Figure 1:
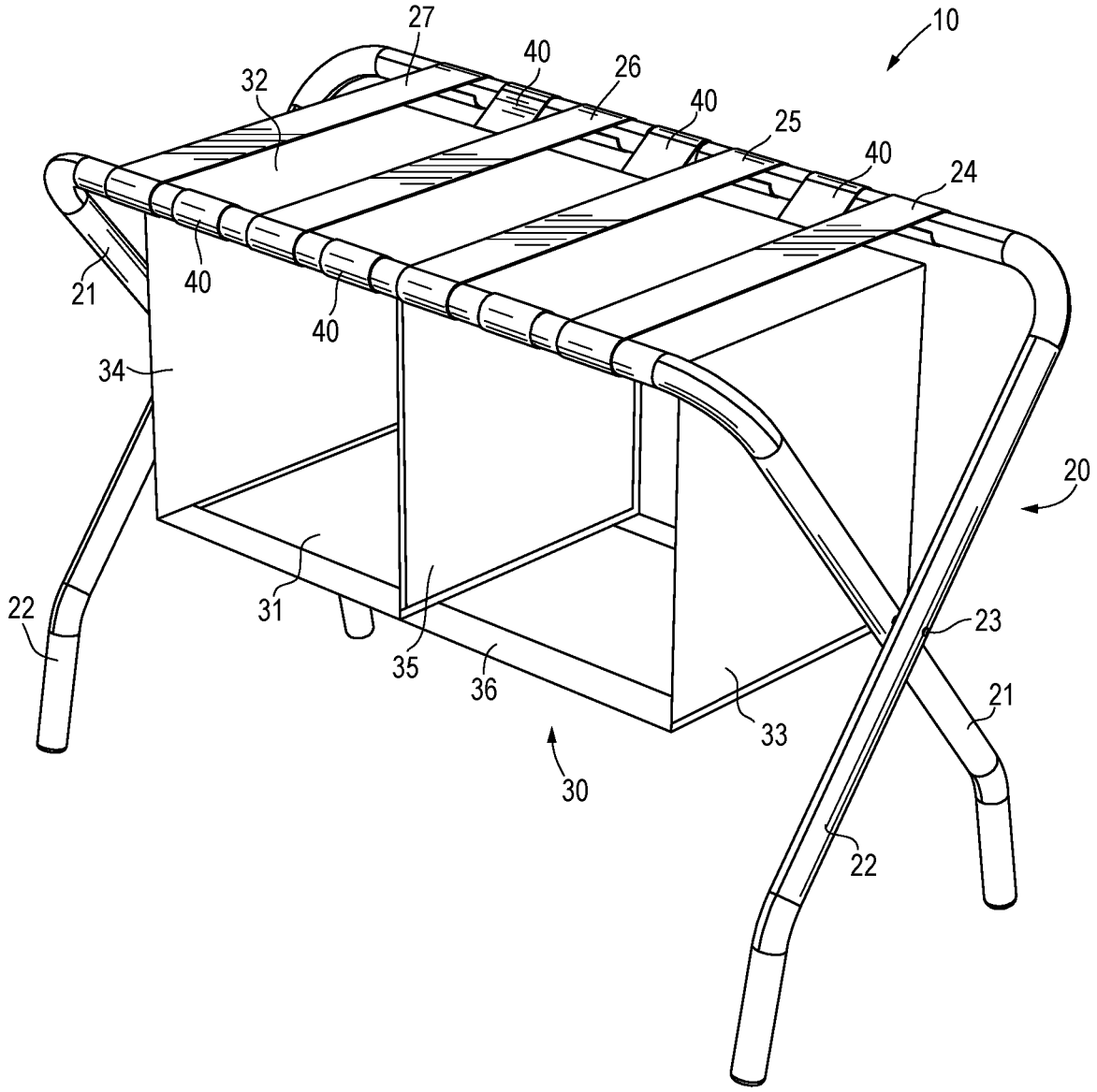
FIG. 1 shows a perspective view of an embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

As stated above, the present invention relates to a luggage rack that includes a seat portion, upon which a piece of luggage, such a suitcase can sit, that includes storage shelves or boxes suspended therefrom. The boxes or shelves can be used to conveniently and efficiently store additional items.

Turning to the drawings, FIG. 1 shows a unit 10 of the present invention that includes a frame 20 and a storage unit 30. The frame includes a pair of crossing legs 21, 22. The legs are generally have the shape of a squared U, with two angled vertical sections and an upper horizontal section. They are secured together by fasteners 23 at two pivot points. The pivot point is usually near the midsection of the vertical section of the legs. The top portion of the legs are joined by support bands 24, 25, 26, 27, that form the seat portion, upon which the luggage rests.

The leg portions 21, 22 of the frame are typically metal and tubular. They can be one piece or several pieces that are joined together. The leg portions can also be made of other materials, wood and plastic being examples. The fasteners 23 are not known to be critical and can vary as well. They can be a simple nut and bolt arrangement, for example. They only have to secure the legs together, and allow for them to pivot when the frame is folded/closed.

The support bands 24, 25, 26, 27 that form the seat are typically a simple strap. They are typically fabric, but can be plastic as well. They are flexible to accommodate the folding of the frame. There should be at least two, but typically more than two are used in order to better support the luggage. Alternatively, the support bands can be substituted for a single piece of fabric that covers most or all of the seat portion. However, when a single piece of fabric is used, there must be apertures to allow for the storage compartment 30 to be attached to the frame.

The storage unit shown in FIG. 1 is two boxes. The component shown has a floor 31, a top 32, a right outer wall 33, and a left outer wall 34. The length of the floor 31 and the top 32 is any distance between the vertical portions of the legs 21 and 22. The storage component also has at least one inner wall 35. The inner wall 35 can be oriented vertically, joining the floor 31 and the top 32. Alternatively, the inner wall 35 can be orientated horizontally to join the outer walls. In other embodiments, multiple inner walls can be used, and they can form multiple shelves, boxes and rows of boxes. The storage unit attaches to the frame by support straps 40 that attach to the frame. Additionally, an optional back wall can be incorporated into the storage unit. The storage unit can also include a border 36. This element can have increased stiffness when compared to the rest of the floor, allowing it to better accommodate objects. The top can also optionally include a border with increased stiffness. The border can be multiple sewn layers of the same material as the floor or top, or can be a different material.

Figure 2:
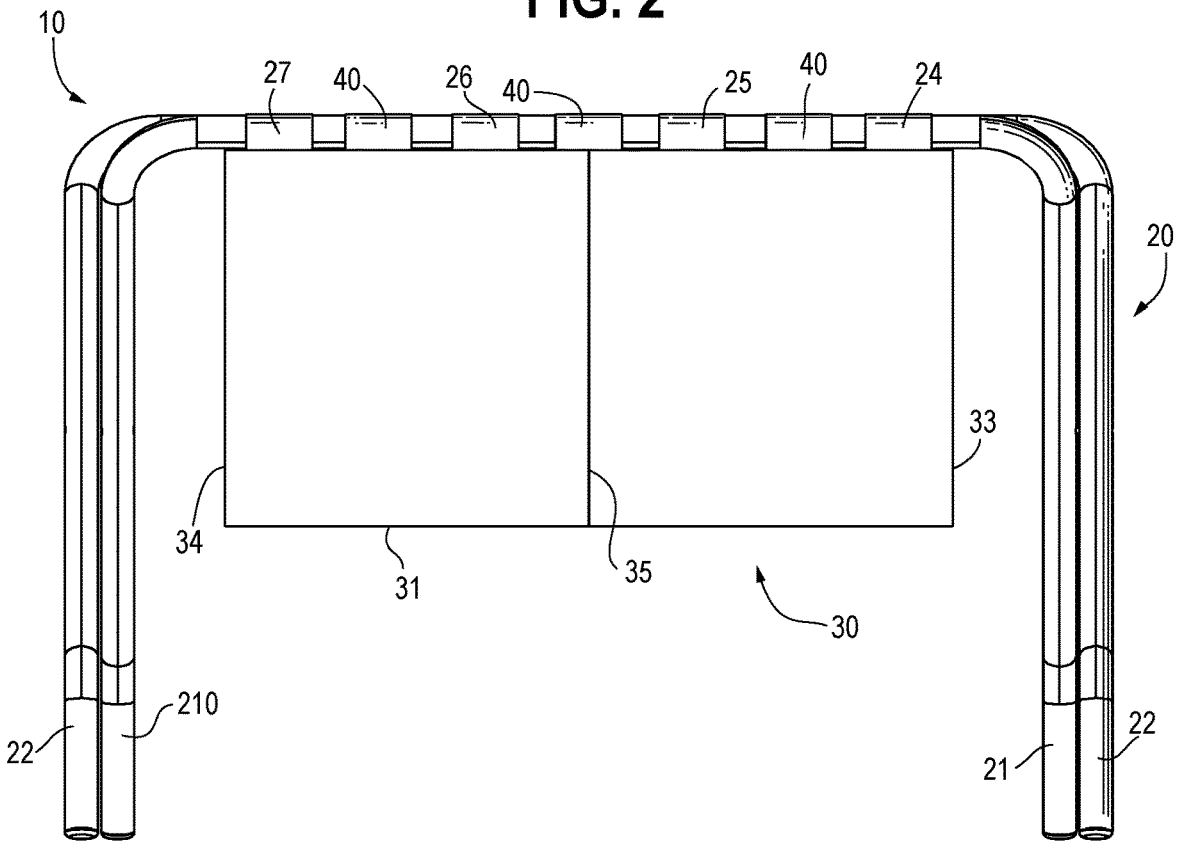
FIG. 2 shows front view of an embodiment of the present invention, with the luggage rack in an open position.

FIG. 2 shows a front view of an example of an unit 10 of the present invention. Here, the frame 20 is open. The storage unit 30 is supported by the frame 20. In this embodiments, the support straps 40 for the storage unit are spaced in-between the support bands 24, 25, 26, 27, that form the seat portion of the frame. This arrangement gives the support unit better stability. Also, shown here is one vertical inner wall 35, so the support unit forms two boxes.

Figure 3:
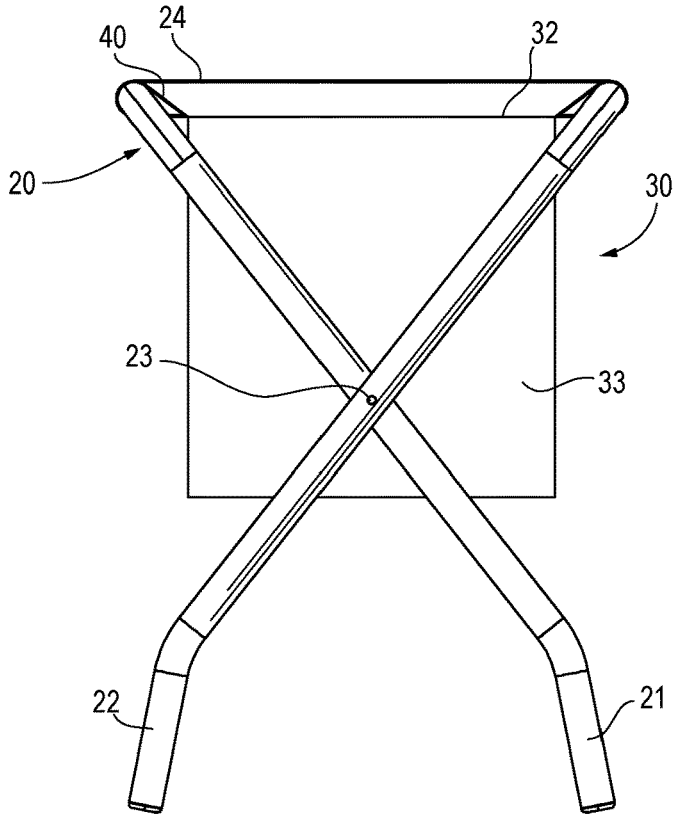
FIG. 3 shows a side view of an embodiment of the present invention, with the luggage rack in an open position.

FIG. 3 shows a side view of an example of a unit 10 of the present invention. Like in FIG. 1, the frame 20 is open. This view shows the storage unit 30 attached to the frame 20 by support straps 40 attached to the top of the frame 20. The top 32 is below the support bands of the frame.

Figure 4:
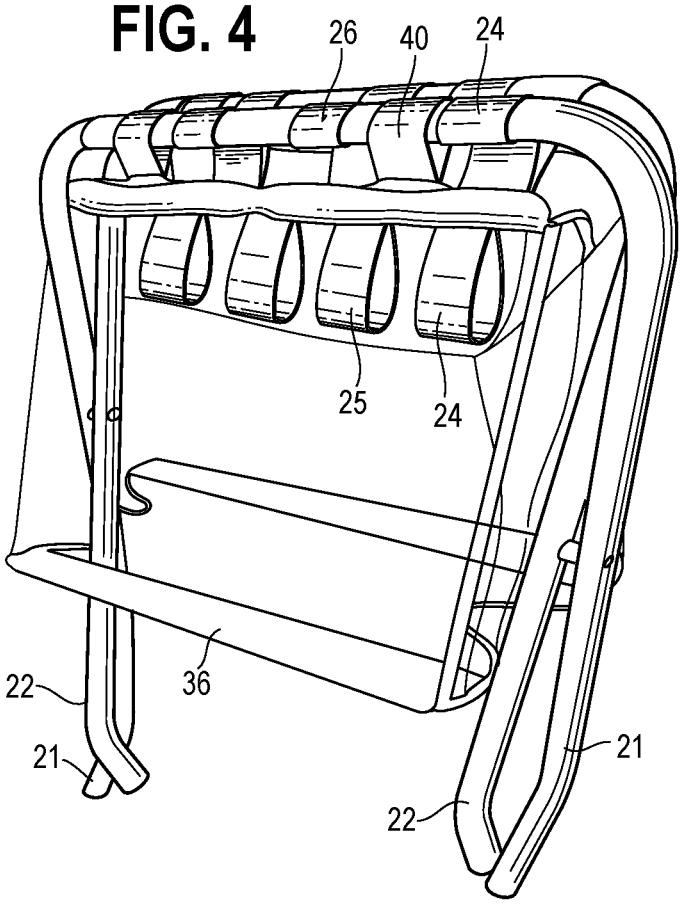
FIG. 4 shows a perspective view of an embodiment of the present invention, with the luggage rack in a folded, or closed position.

FIG. 4 demonstrates that the frame 20 can be folded about the pivot 23 with the storage unit 30 still attached to the frame 20. Embodiments of the storage unit are flexible enough to accommodate this feature. This can be accomplished with flexible outer walls.

Figure 5:
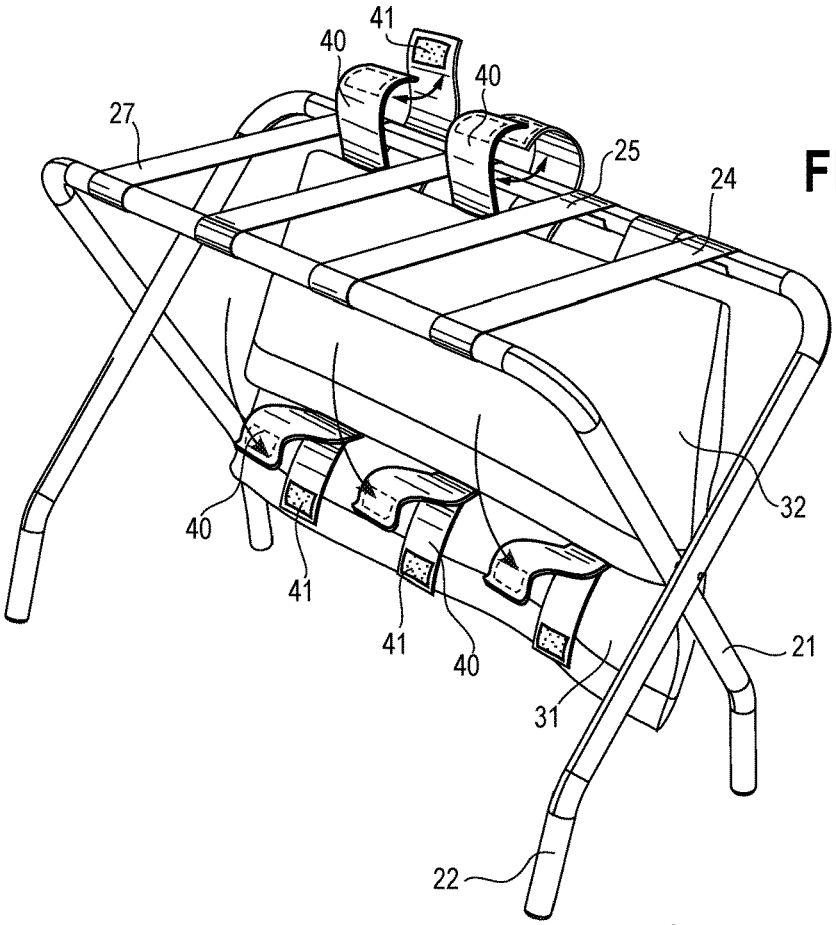
FIG. 5 shows a perspective view of an embodiment of the present invention, showing the additional storage component being attached to a luggage rack.
Figure 6:
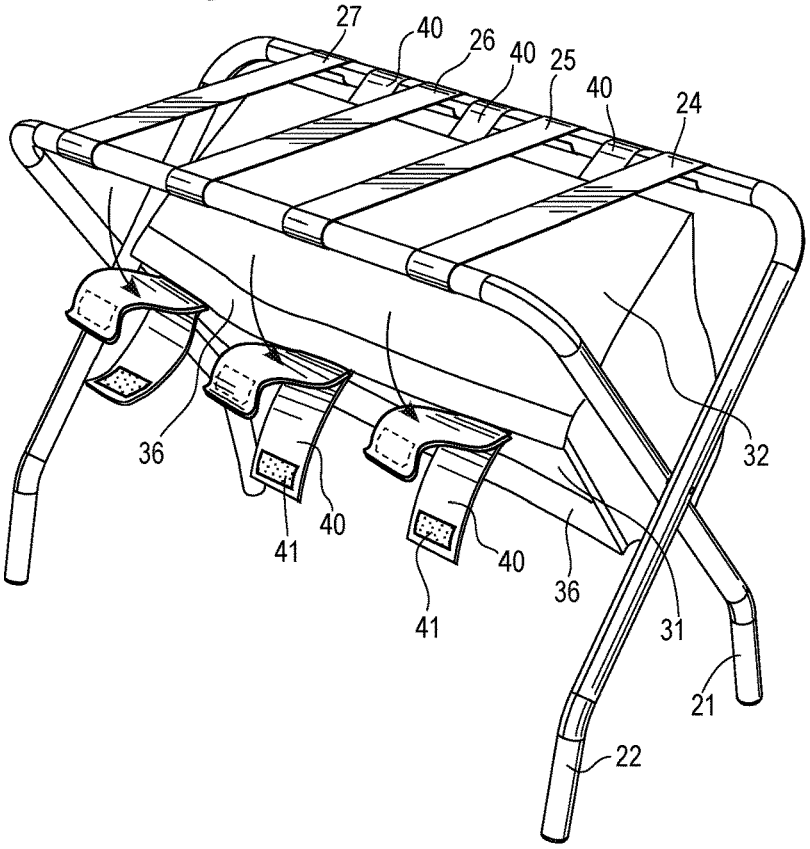
FIG. 6 shows a perspective view of an embodiment of the present invention, showing the additional storage component being attached to a luggage rack.

FIGS. 5 and 6 show an example of how the storage unit 30 may be attached to the frame 20. In the example shown, the storage unit 30 is releasably attached. This allows it to be used with various styles and designs of luggage racks. FIGS. 5 and 6 show an open frame with the support bands 24, 25, 26, 27, extended. The back support straps 40 attach around the top of the legs.

As shown in these figures, the storage compartment has three support straps 40 for each leg. The support straps are attached to the top 32 of the storage compartment. The specifically nature of the straps is not known to be critical, as long as they securely support the storage unit and the items stored therein. The figures depict a strap that comprises two pieces, each connected to the top 32 of the storage compartment. In some embodiments, the straps can simply be tied around the leg. In other embodiments, there is a connection device that secures the two devices together, while around the leg. Examples include a snap or a buckle. Shown in the figures is a simple hook and loop connection 41. This allows for the storage compartment to be releasably attached to the frame. FIG. 5 shows the back row of straps being attached to the frame, while FIG. 6 shows the front row of straps ready for attachment. The length of the straps can vary. Additionally, longer straps can be used if the user prefers the storage unit to hang lower from the seat of the frame.

Figure 7:
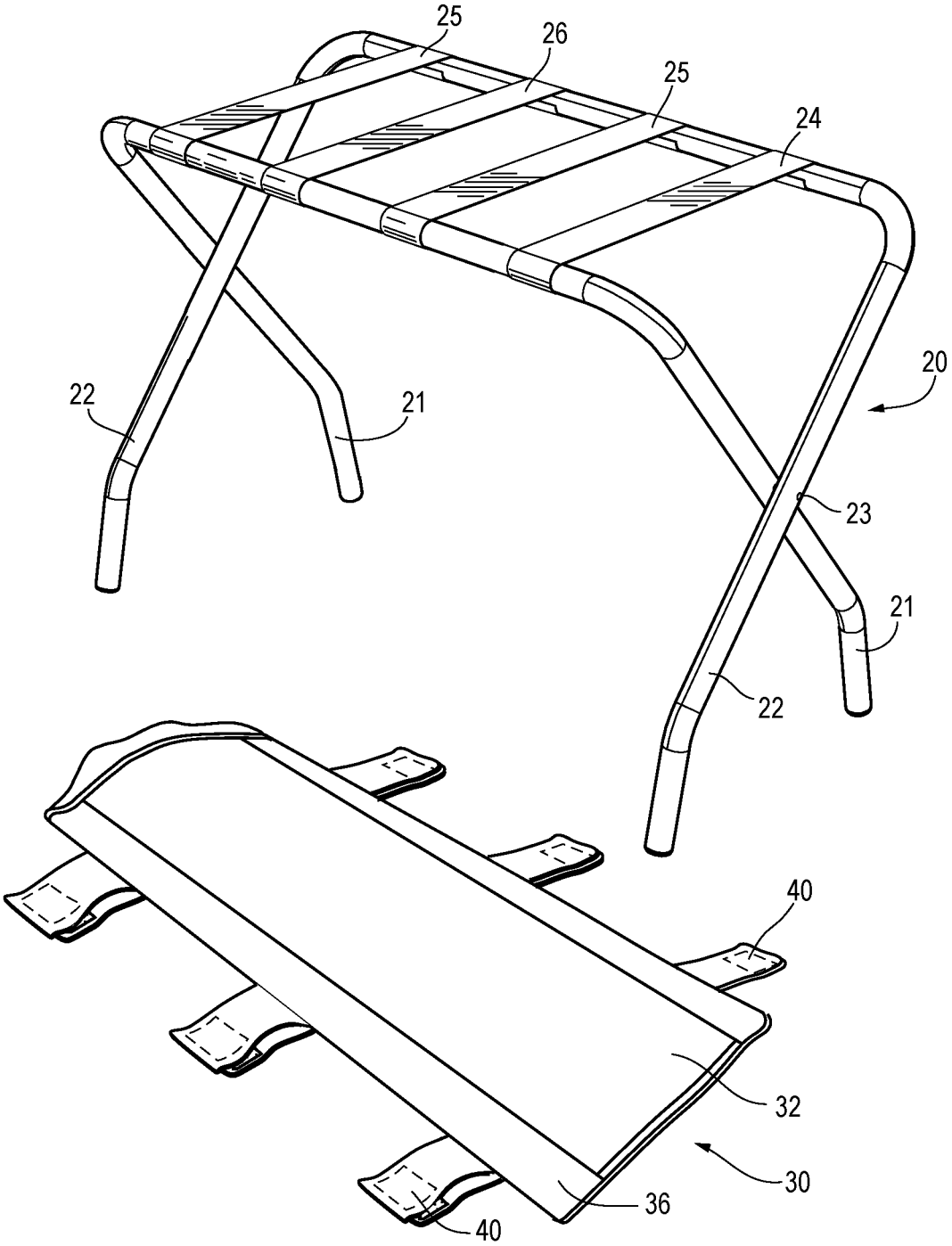
FIG. 7 shows a typical luggage rack that can be used in connection with the present invention, and an embodiment of the storage component that is separated from the rack.

FIG. 7 shows the frame 20 separate from a storage compartment 30. In other words, in FIG. 7, the storage unit is completely detached. As can be seen in the drawings, the storage unit is easily packaged and shipped, separately than any luggage rack frame.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

We claim:

1. A luggage rack, comprising:

a frame and a storage compartment;

said frame comprising two legs that have a first end, an upper portion, and a second end; said legs being joint at a first and second pivot point, the pivot point being between the ends and the upper portion;

at least two support bands attached to the upper portions of both legs;

said storage compartment comprising a top, bottom, and two outer walls, and at least two support straps attached to the storage compartment top and releasably attached to the upper portion of the first leg and the upper portion of the second leg; and wherein at least one storage compartment support strap is in between two frame support bands, and the bottom of the storage compartment hangs free when the support strap engages the frame.

2. The luggage rack of claim 1, wherein the storage compartment hangs from the upper portions by the support straps.

3. The luggage rack of claim 1, wherein at least two support bands join the upper portions of the legs.

4. The luggage rack of claim 1, wherein the storage compartment has four support straps for attaching to the upper portions of the legs.

5. The luggage rack of claim 1, wherein the storage compartment further includes an inner wall that joins the top and bottom of the storage compartment.

6. The luggage rack of claim 1, wherein the storage compartment is fabric.

7. The luggage rack of claim 5, wherein the storage compartment outer walls and inner wall are at least partially a mesh fabric.

8. The luggage rack of claim 1, wherein the frame has four supports bands connecting the tops of the legs, and the storage compartment has six support straps for attaching to the legs.

9. The luggage rack of claim 1, wherein the bottom of the storage compartment has a border that has increased stiffness when compared to the remainder of the bottom.

10. The luggage rack of claim 1, wherein the storage compartment support straps releasably attach to the legs with a hook and loop connection.

11. The luggage rack of claim 1, wherein the pivot points allow the upper portions of the legs to be folded from an open position to a folded position; wherein the storage compartment collapses into a folded position when the legs are pivoted into the folded position and expands into an open position when the legs are pivoted into the open position.

12. The luggage rack of claim 1, wherein the storage compartment has at least two storage compartment support straps, and the storage compartment support straps alternate with a frame band when attached to the frame.

* * * * *